United States Patent [19]

Nakanishi et al.

[11] Patent Number: 4,504,763

[45] Date of Patent: Mar. 12, 1985

[54] CATHODE RAY TUBE PROVIDED WITH A POTTED BASE

[75] Inventors: Masayuki Nakanishi, Isezaki; Hirohisa Tsuruzoe, Fukaya; Humiyuki Sato, Fukaya; Tokuo Hashimoto, Fukaya, all of Japan

[73] Assignee: Tokyo Shibaura Denki Kabushiki Kaisha, Japan

[21] Appl. No.: 406,915

[22] Filed: Aug. 10, 1982

[30] Foreign Application Priority Data

Aug. 14, 1981 [JP] Japan ..... 56-126791

[51] Int. Cl.[3] ..... H01J 5/48

[52] U.S. Cl. ..... 313/318; 313/482; 339/144 R

[58] Field of Search ..... 313/446, 456, 482, 318; 339/145 R, 144 T, 144 R

[56] References Cited

U.S. PATENT DOCUMENTS 4,106,840 8/1978 Tyson ..... 313/318 X
4,379,978 4/1983 Hockenbrock ..... 313/318

FOREIGN PATENT DOCUMENTS 564546 10/1944 United Kingdom ..... 313/456

OTHER PUBLICATIONS

Rohrer, "Electronic Tube Base Potting", Electronics, May 6, 1960, pp. 84–86.

*Primary Examiner*—David K. Moore
*Assistant Examiner*—Vincent DeLuca
*Attorney, Agent, or Firm*—Cushman, Darby & Cushman

[57] ABSTRACT

A cathode ray tube with a potted base is provided which comprises: a plurality of stem pins which extend through a stem mounted at an end of a neck and fixed to the stem; an insulating housing which is mounted on the stem and which is formed integrally with a base having holes for receiving the stem pins, most of the bottom of the housing comprising the base; terminals for connecting leads extending into the housing from the outside to the stem pins extending into the housing from below through the holes in the base; an insulating material which is filled in the housing and which fixes the stem pins, the leads and the terminals; and an insulating adhesive for adhering the stem to the bottom of the housing.

2 Claims, 4 Drawing Figures

CATHODE RAY TUBE PROVIDED WITH A POTTED BASE

BACKGROUND OF THE INVENTION

The present invention relates to a cathode ray tube provided with a potted base and, more particularly, to an improvement in the potted base.

A cathode ray tube is frequently used as a transmission means of instructions and/or information in control devices for various types of equipment and systems. These control devices are quite frequently used under extremely severe conditions. Moreover, high reliability is required for the control devices including display devices since troubles of the display devices may lead to serious accidents of the overall systems under the control of the control devices. An example of such a control device is a pilotage control section of an aircraft.

In a cathode ray tube for a general television receiver, connecting leads from a drive circuit are connected through a socket to stem pins extending from the base of the cathode ray tube. If such a cathode ray tube is used for the control devices of the type as described above, the reliability is significantly degraded due to creeping discharge caused by high humidity or a drop in the atmospheric pressure, incomplete contact between the socket and stem pins caused by vibrations, and degradation in the mechanical strength.

For this reason, in a cathode ray tube for a control device of the type described above, connecting leads from a drive section are connected to the stem pins, and the overall base is sealed and insulated with an insulating adhesive such as silicone rubber.

An example of a cathode ray tube of this type will now be described with reference to FIGS. 1 and 2. Referring to these figures, the cathode ray tube comprises a panel or faceplate 2 with a phosphor screen 1 formed on its inner surface, a neck 4 connected to the panel 2 through a funnel 3, a stem 7 through which extend stem pins 6 which support an electron gun 5 mounted within the neck 4 and which apply a predetermined voltage to the respective electrodes of the electron gun 5, and a base 8 connected to the outer side of the stem 7. In order to connect the stem pins 6 to the drive circuit, the base 8 is tightly adhered to the outer side of the stem 7 with an insulating adhesive 9, as shown in FIG. 2. Then, a plurality of connecting leads 10 from the drive section are connected to the stem pins 6 through terminals 11. A mold 12 of a silicone resin is mounted such that its axis is aligned with the axis of the tube, and a sealing material 13 is applied to seal a gap between the mold 12 and the neck 4.

Silicone rubber 14 defoamed under a vacuum is injected into the mold 12 and cured. Thereafter, the sealing material 13 and the mold 12 are removed.

In this manner, the leads 10 are connected to the stem pins 6, and are sealed and insulated by the silicone rubber 14.

A cathode ray tube of this type requires a jig so as to mount the axis of the mold 12 substantially in alignment with the axis of the tube. Care must be taken to completely seal the silicone rubber 14. Although the silicone rubber 14 is defoamed under a vacuum before injection, air may be trapped therein during injection. If the injection speed of the silicone rubber 14 is increased, an air void is formed inside the mold 12, thus degrading insulation characteristics.

SUMMARY OF THE INVENTION

It is, therefore, an object of the present invention to provide a cathode ray tube provided with a potted base, which is high in insulation reliability and which is easy to manufacture.

In order to achieve the above and other objects of the present invention, there is provided according to the present invention a cathode ray tube provided with a potted base, comprising: a plurality of stem pins which extend through a stem mounted at an end of a neck and fixed to said stem; an insulating housing which is mounted on said stem and which is formed integrally with a base having holes for receiving said stem pins, most of a bottom of said housing comprising said base; terminals for connecting leads extending into said housing from the outside to said stem pins extending into said housing from below through said holes in said base; an insulating material which is filled in said housing and which fixes said stem pins, said leads and said terminals; and an insulating adhesive for adhering said stem to said bottom of said housing.

BRIEF DESCRIPTION OF THE DRAWINGS

FIGS. 1 and 2 show a conventional cathode ray tube wherein FIG. 1 is a partially cutaway side view showing a cathode ray tube with a stem connected to a base, and FIG. 2 is a partial sectional view of a cathode ray tube during one manufacturing step; and FIGS. 3 and 4 show an embodiment of a cathode ray tube of the present invention wherein FIG. 3 is a partially cutaway view showing a housing formed integrally with a base and connected to a stem of the cathode ray tube, and FIG. 4 is a partial sectional view of the cathode ray tube.

DETAILED DESCRIPTION OF THE PREFERRED EMBODIMENT

Figure 1:
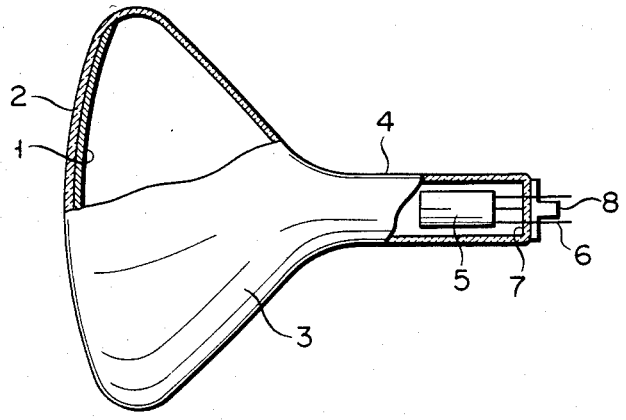
FIG. 1 PRIOR ART
Figure 2:
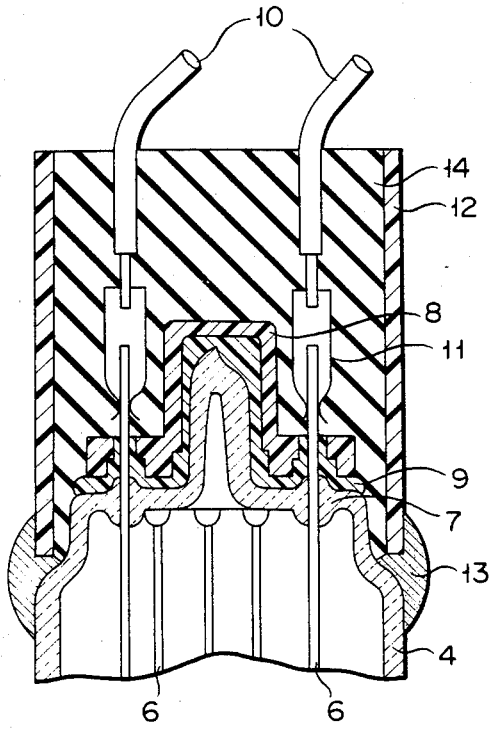
FIG. 2 PRIOR ART
Figure 3:
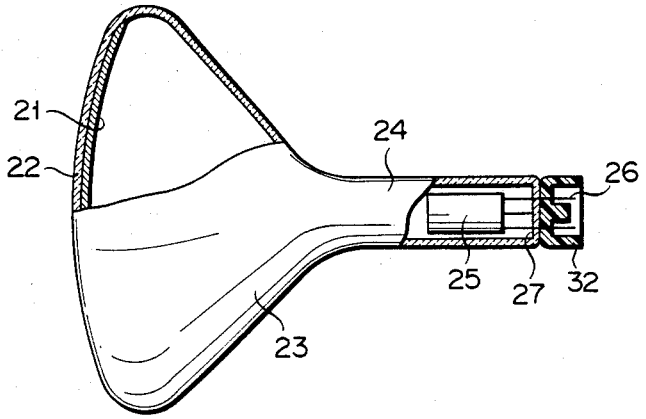
Figure 4:
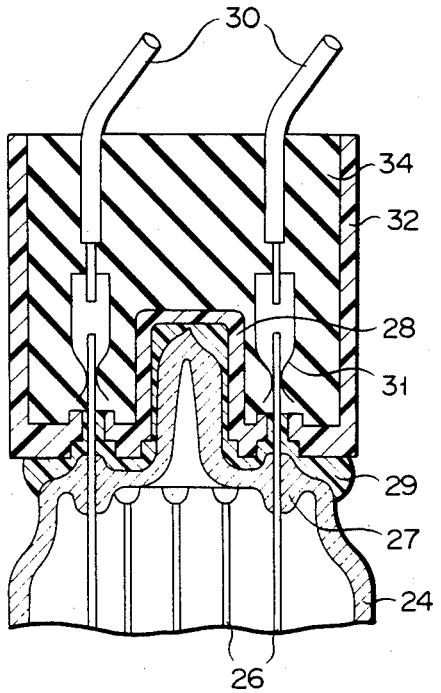

An embodiment of a cathode ray tube of the present invention will now be described with reference to FIGS. 3 and 4. Referring to FIG. 3, a phosphor screen 21 is formed on the inner surface of a panel 22 of the cathode ray tube. Reference numerals 23 and 24 respectively denote a funnel and a neck of the cathode ray tube, and an electron gun 25 is held within the neck 24. Referring to FIG. 4, a stem 27 extends at one end of the neck 24. A plurality of stem pins 26 for applying a predetermined voltage to the respective electrodes of the electron gun 25 extend through the stem 27 and fixed thereto. A base 28 has holes for receiving the stem pins 26. A housing 32 made of a silicone resin formed integrally with the base 28 is fixed on the stem 27 through an insulating adhesive 29. Terminals 31 connect the stem pins 26 projecting into the housing 32 through the holes formed in the base 28 to connecting leads 30 extending from the outside. The leads 30, the terminals 31 and the stem pins 26 are sealed and insulated by silicone rubber 34 filled in the inner cavity inside the housing 32. A cathode ray tube provided with a potted base of the arrangement described above is assembled in the manner as follows. First, the insulating housing 32 formed integrally with the base 28 and a jig (not shown) which has a stem pin arrangement same as that described above are prepared. The stem pins of the jig are inserted into the opening of the housing 32 through the holes in the base 28 with the opening of the housing 32 facing upward. After connecting the leads 30 to the stem pins of the jig though the terminals 31, a liquid silicone rubber is injected into the housing 32 and defoaming under a vacuum is performed. The liquid silicone rubber is cured to provide silicone rubber 34. Next, the housing 32 filled with the silicone rubber 34 is released from the jig. Stem pins 26 extending inside a stem 27 of a separately prepared cathode ray tube are inserted into the housing 32 through the holes formed in the base 28. The bottom of the housing 32 is adhered to the stem 27 through an insulating adhesive 29. As a result, a desired cathode ray tube provided with a potted base is prepared.

In a cathode ray tube of the arrangement of the present invention as described above, since the housing 32 is formed integrally with the base 28, the liquid silicone rubber injected into the interior of the housing 32 may not leak to the outside. Therefore, defoaming under a vacuum may be performed after the silicone rubber is injected into the housing 32, so that insulation reliability is improved. The axis of the housing 32 may be easily aligned with the axis of the tube by simply inserting the stem pins 26 as guides into the housing 32. Unlike a conventional cathode ray tube, the sealing material 13 for preventing leakage of the silicone rubber from the mold 12 may be dispensed with. In the embodiment described above, silicone rubber is filled in the housing 32. However, the present invention is not limited to this. For example, another insulating material may be used which may be cured after being injected into the housing.

What we claim is:

1. A cathode ray tube having a stem mounted at an end of a neck and provided with a potted base, said cathode ray tube comprising:

a plurality of stem pins which extend through said stem mounted at said end of said neck and fixed to said stem;

an insulating housing which is mounted on said stem, said housing at one end including an integral base having holes for receiving said stem pins which extend through said stem, most of a bottom of said housing comprising said base, and wherein said housing defines an open end opposite to said one end to establish a housing cavity with said integral base;

terminals for connecting (a) leads extending into said housing cavity from the outside through said open end to (b) said stem pins extending into said housing cavity from below through said holes in said base;

an insulating molding material which is filled in said housing cavity and which fixes said stem pins, said leads and said terminals; and an insulating adhesive for adhering said stem to said bottom of said housing, wherein said insulating adhesive is a different material from said insulating molding material, and wherein said insulating molding material is cured within said housing cavity before said bottom of said housing is adhered to said stem.

2. A cathode ray tube according to claim 1, wherein said insulating material is silicone rubber.

* * * * *